United States Patent [19]

Burmeister et al.

[11] Patent Number: 4,925,411

[45] Date of Patent: May 15, 1990

[54] MARINE PROPULSION DEVICE TILT AND TRIM MECHANISM

[75] Inventors: Scott N. Burmeister, Gurnee; Duane W. Harris, Lake Villa; Roger B. Whipple, Waukegan; Martin J. Mondek, Wonder Lake, all of Ill.

[73] Assignee: Outboard Marine Corporation, Waukegan, Ill.

[21] Appl. No.: 403,985

[22] Filed: Sep. 6, 1989

Related U.S. Application Data

[63] Continuation of Ser. No. 56,860, Jun. 1, 1987, abandoned.

[51] Int. Cl.[5] ..... B03H 5/12

[52] U.S. Cl. ..... 440/61; 440/62; 440/65

[58] Field of Search ..... 440/49, 53, 61, 56, 440/65, 62; 248/640; 91/422; 92/9, 13, 13.1, 26, 75, 134

[56] References Cited

U.S. PATENT DOCUMENTS

| | | | |
|---|---|---|---|
| 3,008,445 | 11/1961 | Frank | 115/41 |
| 3,029,770 | 4/1962 | Anderson | 115/41 |
| 3,039,724 | 6/1962 | Herreman | 248/4 |
| 3,983,835 | 10/1976 | Hall | 115/41 |
| 3,990,660 | 11/1976 | Pipoz | 248/4 |
| 4,064,824 | 12/1977 | Hall et al. | 115/41 |
| 4,096,820 | 6/1978 | Hall | 115/41 |
| 4,325,700 | 4/1982 | Kern et al. | 440/61 |
| 4,490,120 | 12/1984 | Hundertmark | 440/61 |
| 4,493,659 | 1/1985 | Iwashita | 440/61 |
| 4,498,871 | 2/1985 | Hall et al. | 440/61 |
| 4,521,202 | 6/1985 | Nakahama | 440/61 |
| 4,545,769 | 10/1985 | Nakahama et al. | 440/61 |
| 4,551,104 | 11/1985 | Iwashita et al. | 440/56 |
| 4,565,528 | 1/1986 | Nakase | 440/1 |
| 4,575,342 | 3/1986 | Nakahama et al. | 440/56 |
| 4,605,377 | 8/1986 | Wenstadt | 440/61 |
| 4,687,449 | 8/1987 | Fenrich | 440/61 |
| 4,718,872 | 1/1988 | Olson et al. | 440/1 |

FOREIGN PATENT DOCUMENTS

| | | |
|---|---|---|
| 49-38329 | 10/1974 | Japan . |
| 49-40097 | 11/1974 | Japan . |
| 55-17874 | 4/1980 | Japan . |

*Primary Examiner*—Sherman D. Basinger
*Assistant Examiner*—Stephen P. Avila
*Attorney, Agent, or Firm*—Michael, Best & Friedrich

[57] ABSTRACT

A marine propulsion device comprising a propulsion unit adapted to be mounted on the transom of a boat for pivotal movement relative to the transom about a generally horizontal tilt axis, and about a vertical steering axis, the propulsion unit including a rotatably mounted propeller, and an engine drivingly connected to the propeller, a tiller arm connected to the propulsion unit, a contractable and extendible hydraulic assembly including a cylinder connected to one of the propulsion unit and the transom, a piston slideably received in the cylinder and dividing the cylinder into opposite first and second chambers, and a piston rod having one end fixedly connected to the piston and an opposite end extending outwardly of the cylinder and being connected to the other of the propulsion unit and the transom, a valve for alternatively permitting and preventing fluid flow from the first chamber to the second chamber, and a lever mounted on the tiller arm for actuating the valve.

39 Claims, 1 Drawing Sheet

MARINE PROPULSION DEVICE TILT AND TRIM MECHANISM

This application is a continuation of co-pending application Ser. No. 056,860, filed June 1, 1987, now abandoned.

BACKGROUND OF THE INVENTION

The invention relates to marine propulsion device tilt and trim mechanisms, and, more particularly, to hydraulic tilt and trim mechanisms which contain a compressible fluid or gas.

Borst U.S. Pat. No. 3,863,592 discloses a combined damping and lift means for a marine propulsion device. This means includes a hydraulic cylinder-piston assembly connected between the transom bracket and swivel bracket of a marine propulsion device, with the cylinder containing a compressible fluid or gas. The function of the hydraulic assembly is to provide an upward force on the swivel bracket, thereby assisting manual upward tilting of the propulsion unit, and also to damp downward tilting movement of the propulsion unit. The hydraulic assembly alone cannot be used to set the bottom trim position of the propulsion unit since it does not limit downward tilting movement of the propulsion unit. Accordingly, the marine propulsion device is provided with a conventional trim adjustment or thrust pin for setting the trim position of the propulsion unit.

Iwashita U.S. Pat. No. 4,493,659 discloses a hydraulic cylinder-piston assembly with the cylinder containing a compressible fluid or gas. The hydraulic assembly also includes a by-pass valve for permitting fluid flow between the cylinder chambers. When the by-pass valve is open, fluid can flow freely between the cylinder chambers, and the propulsion unit can be manually tilted. FIGS. 14–17 of the Iwashita patent illustrate an embodiment which allows the operator to selectively lock the drive unit in any tilt position. However, the hydraulic assembly has a complicated construction, including a free-floating disc 236, and the cylinder chamber 46 that opposes contraction of the hydraulic assembly contains gas. This results in an unstable or "mushy" trim setting.

Attention is also directed to the following U.S. Pat. Nos.:

| | | |
|---|---|---|
| Wenstadt | 4,605,377 | 08/12/86 |
| Nakase | 4,565,528 | 01/21/86 |
| Hall | 4,096,820 | 06/27/78 |
| Frank | 3,008,445 | 11/14/61 |
| Anderson | 3,029,770 | 04/17/62 |
| Herreman | 3,039,724 | 06/19/62 |
| Hall | 3,983,835 | 10/05/76 |
| Hall, et al. | 4,064,824 | 12/27/77 |
| Nakahama | 4,521,202 | 06/04/85 |
| Nakahama, et al. | 4,545,769 | 10/08/85 |
| Iwashita, et al. | 4,551,104 | 11/05/85 |
| Nakahama, et al. | 4,575,342 | 03/11/86 |

SUMMARY OF THE INVENTION

The invention provides a marine propulsion device comprising a propulsion unit adapted to be mounted on the transom of a boat for pivotal movement relative thereto about a generally horizontal tilt axis, the propulsion unit including a rotatably mounted propeller, and an engine drivingly connected to the propeller, a hydraulic assembly including a cylinder pivotally connected to one of the transom and the propulsion unit, and a piston slidably housed in the cylinder and defining a chamber in the cylinder, the chamber containing substantially only incompressible fluid, and the assembly also including a piston rod located outside of the chamber and having one end fixedly connected to the piston and an opposite end pivotally connected to the other of the transom and the propulsion unit, means including a pressurized gas for pressurizing the chamber, and means for selectively preventing diminishment of the volume of incompressible fluid in the chamber to thereby prevent contraction of the assembly under all thrust conditions.

The invention also provides a marine propulsion device comprising a propulsion unit adapted to be mounted on the transom of a boat for pivotal movement relative thereto about a generally horizontal tilt axis, the propulsion unit including a rotatably mounted propeller, and an engine drivingly connected to the propeller, a hydraulic assembly including a cylinder having a lower end pivotally connected to the transom, and a piston dividing the cylinder into upper and lower chambers, the upper chamber containing gas and incompressible fluid, and the lower chamber containing substantially only incompressible fluid, and the assembly also including a piston rod extending through the upper chamber and having a lower end fixedly connected to the piston and an upper end pivotally connected to the propulsion unit, a conduit communicating between the upper and lower chambers, the conduit having an upper end communicating with the upper chamber at a point located below the level of incompressible fluid in the upper chamber, and a manually operable valve for opening and closing the conduit.

The invention also provides a marine propulsion device comprising a propulsion unit adapted to be mounted on the transom of a boat for pivotal movement relative to the transom about a generally horizontal tilt axis, and for pivotal movement relative to the transom about a generally vertical steering axis, the propulsion unit including a rotatably mounted propeller, and an engine drivingly connected to the propeller, a tiller arm connected to the propulsion unit for causing pivotal movement of the propulsion unit about the steering axis, a hydraulic assembly including a cylinder connected to one of the propulsion unit and the transom, a piston slideably received in the cylinder and dividing the cylinder into opposite first and second chambers, and a piston rod having one end fixedly connected to the piston and an opposite end extending outwardly of the cylinder and being connected to the other of the propulsion unit and the transom, valve means for alternatively permitting and preventing fluid flow between the chambers, operator actuatable means mounted on the tiller arm, and means for actuating the valve means in response to actuation of the operator actuatable means.

The invention also provides a marine propulsion device comprising a transom bracket adapted to be fixedly mounted on the transom of a boat, a propulsion unit mounted on the transom bracket for pivotal movement relative thereto about a generally horizontal tilt axis, the propulsion unit including a rotatably mounted propeller, and an engine drivingly connected to the propeller, a hydraulic assembly including a cylinder connected to one of the propulsion unit and the transom bracket, a piston slideably received in the cylinder and dividing the cylinder into opposite first and second chambers, and a piston rod having one end fixedly connected to the piston and an opposite end extending outwardly of the cylinder and being connected to the other of the propulsion unit and the transom bracket, valve means for alternatively permitting and preventing fluid flow between the chambers, operator actuatable means mounted on the transom bracket, and means for actuating the valve means in response to actuation of the operator actuatable means.

The invention also provides a marine propulsion device comprising a propulsion unit adapted to be mounted on the transom of a boat for pivotal movement relative to the transom about a generally horizontal tilt axis, the propulsion unit including a rotatably mounted propeller, and an engine drivingly connected to the propeller, a hydraulic assembly including a cylinder connected to one of the propulsion unit and the transom, a piston slideably received in the cylinder and dividing the cylinder into opposite first and second chambers, the second chamber containing a compressible fluid, and a piston rod having one end fixedly connected to the piston and a second end extending outwardly of the cylinder and being connected to the other of the propulsion unit and the transom, means for permitting fluid flow between the first and second chambers, and means for returning compressible fluid from the first chamber to the second chamber.

The invention also provides a marine propulsion device comprising a propulsion unit adapted to be mounted on the transom of a boat for pivotal movement relative to the transom about a generally horizontal tilt axis, the propulsion unit including a rotatably mounted propeller, and an engine drivingly connected to the propeller, a hydraulic assembly including a cylinder having a longitudinal axis and being connected to one of the propulsion unit and the transom, a piston slideably received in the cylinder and dividing the cylinder into opposite first and second chambers, and a piston rod having one end fixedly connected to the piston and a second end extending outwardly of the cylinder and being connected to the other of the propulsion unit and the transom, and valve means for controlling fluid flow between the first and second chambers, the valve means including a valve seat, and a valve member movable along an axis parallel to the longitudinal axis and movable into and out of engagement with the valve seat.

The invention also provides a method for setting the trim position of a marine propulsion device mounted on a boat, the marine propulsion device comprising a propulsion unit including a propeller and being mounted for pivotal movement relative to the boat about a generally horizontal tilt axis, a contractable and extendible hydraulic assembly including a cylinder connected to one of the propulsion unit and the transom, a piston slideably received in the cylinder and dividing the cylinder into opposite first and second chambers, and a piston rod having one end fixedly connected to the piston and an opposite end extending outwardly of the cylinder and being connected to the other of the propulsion unit and the transom, and manually operable valve means for alternatively permitting fluid flow between the chambers, and preventing fluid flow between the chambers, the method comprising the steps of contracting the hydraulic assembly by accelerating the boat while the valve means is open to permit fluid flow between the chambers, extending the hydraulic assembly by decelerating the boat while the valve means is open to permit fluid flow between the chambers, and locking the propulsion unit in the desired trim position.

The invention also provides a hydraulic assembly comprising a cylinder having a longitudinal axis, a piston slideably received in the cylinder and dividing the cylinder into opposite first and second chambers, a piston rod having one end fixedly connected to the piston and a second end extending outwardly of the cylinder, and valve means for controlling fluid flow between the first and second chambers, the valve means including a valve seat, and a valve member movable along an axis parallel to the longitudinal axis and movable into and out of engagement with the valve seat.

A principal feature of the invention is the provision of a marine propulsion device comprising a contractable and extendible hydraulic tilt assembly including a cylinder having an upper chamber which contains an incompressible fluid and a compressible fluid, and a lower chamber containing substantially only incompressible fluid, a piston rod extending through the upper chamber, and means for selectively preventing diminishment of the volume of incompressible fluid in the lower chamber to thereby prevent contraction of the tilt assembly under all thrust conditions In the preferred embodiment, the preventing means includes manually operable valve means for alternatively permitting and preventing fluid flow from the lower cylinder chamber to the upper cylinder chamber.

The assembly assists manual upward tilting of the propulsion unit and damps downward tilting movement of the propulsion unit. Because the assembly does not include a relief valve for permitting contraction of the assembly when contracting forces reach a certain level, the assembly can be used to set the trim position of the propulsion unit under all thrust conditions. Furthermore, the hydraulic assembly permits an infinite number of trim positions.

In the preferred embodiment of the invention, the hydraulic assembly can be used to limit upward movement of the propulsion unit caused by reverse thrust from the propeller, and can be used as a trailer lock, i.e., to lock the propulsion unit in the "up" position during transportation. Therefore, in addition to eliminating the need for a trim pin, the hydraulic assembly eliminates the need for a reverse thrust lock and a trailer lock.

Another principal feature of the invention is the provision of a marine propulsion device comprising a hydraulic tilt assembly, valve means for controlling the tilt assembly, operator actuatable means mounted on the tiller arm or transom bracket, and means for actuating the valve means in response to actuation of the operator actuatable means. This provides a convenient location of the means for controlling the tilt assembly. When the operator actuable means is located on the tiler arm, the operator can simultaneously steer the marine propulsion device and adjust the trim position.

Another principal feature of the invention is the provision of a hydraulic tilt mechanism comprising a cylinder divided into opposite chambers and containing a compressible fluid, means for permitting fluid flow between the chambers, and means for returning compressible fluid from one of the chambers to the other chamber. This arrangement permits the operator to remove compressible fluid from the cylinder chamber that opposes contraction of the hydraulic mechanism so that only incompressible fluid opposes contraction of the mechanism. Therefore, the mechanism provides a stable trim position.

Another principal feature of the invention is the provision of a hydraulic assembly comprising a cylinder having a longitudinal axis, and valve means for controlling fluid flow between the cylinder chambers, the valve means including a valve member movable along an axis parallel to the longitudinal axis of the cylinder. This arrangement facilitates the use of a cable extending over the transom of the boat for actuating the valve means.

Another principal feature of the invention is the above-described method for setting the trim position of the marine propulsion device. Usually, it is necessary to manually adjust the trim position of a marine propulsion device including a tilt mechanism that is not controlled by a pump. The above-described method permits the operator to set the trim position without manual adjustment.

Other features and advantages of the invention will become apparent to those skilled in the art upon review of the following detailed description, claims, and drawings.

Figure 1:
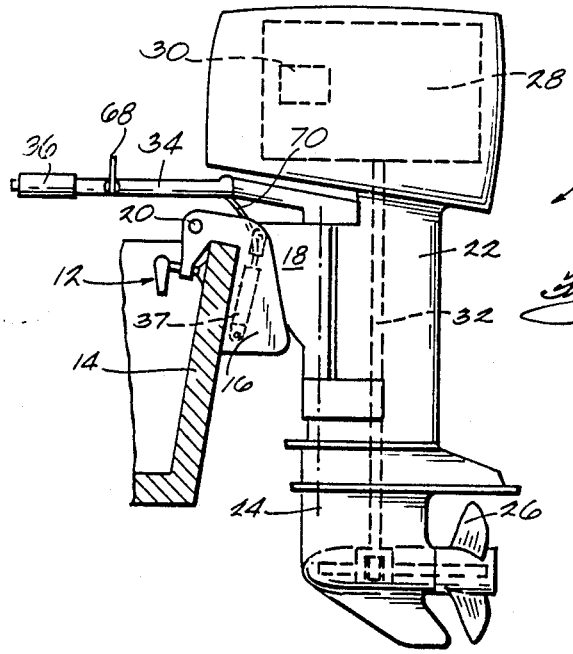
FIG. 1 is a side elevational view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. As shown in FIG. 1, the marine propulsion device 10 comprises a mounting 12 assembly mounted on the transom 14 of a boat. While various suitable mounting assemblies can be used, in the illustrated construction, the mounting assembly 12 includes a transom bracket 16 fixedly mounted on the transom 14, and a swivel bracket 18 mounted on the transom bracket 16 for pivotal movement relative thereto about a generally horizontal tilt axis 20.

The marine propulsion device 10 also comprises a propulsion unit 22 mounted on the swivel bracket 18 for pivotal movement relative thereto about a generally vertical steering axis 24, and for common movement therewith about the tilt axis 20. As is known in the art, the propulsion unit is pivotable about the tilt axis 20 between a lowered or operating position (shown in FIG. 1) and a raised or non-operating position (not shown). The propulsion unit 22 includes a rotatably mounted propeller 26, and an engine 28 which includes a throttle 30 and which is drivingly connected to the propeller 26 by a conventional drive train 32.

The marine propulsion device 10 also comprises a tiller arm 34 connected to the propulsion unit 22 for causing pivotal movement of the propulsion unit 22 about the steering axis 24. As is known in the art, the tiller arm 34 includes a pivotally mounted handle 36 which is operably connected to the throttle 30 for controlling the throttle 30 in response to pivotal movement of the handle 36.

Figure 2:
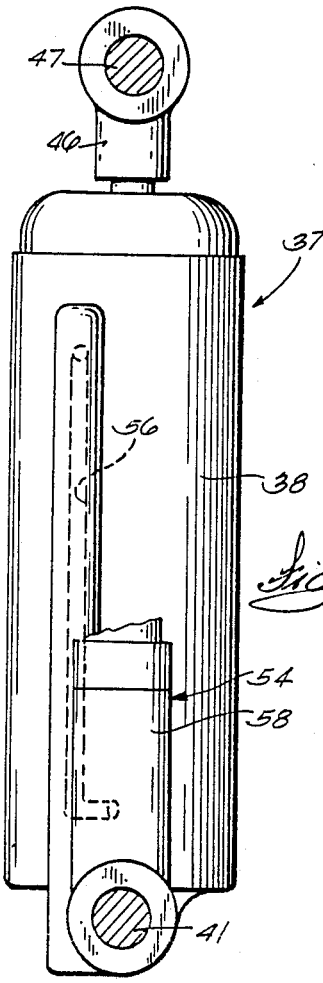
FIG. 2 is an enlarged side elevational view of the cylinder-piston assembly of the tilt and trim mechanism.
Figure 3:
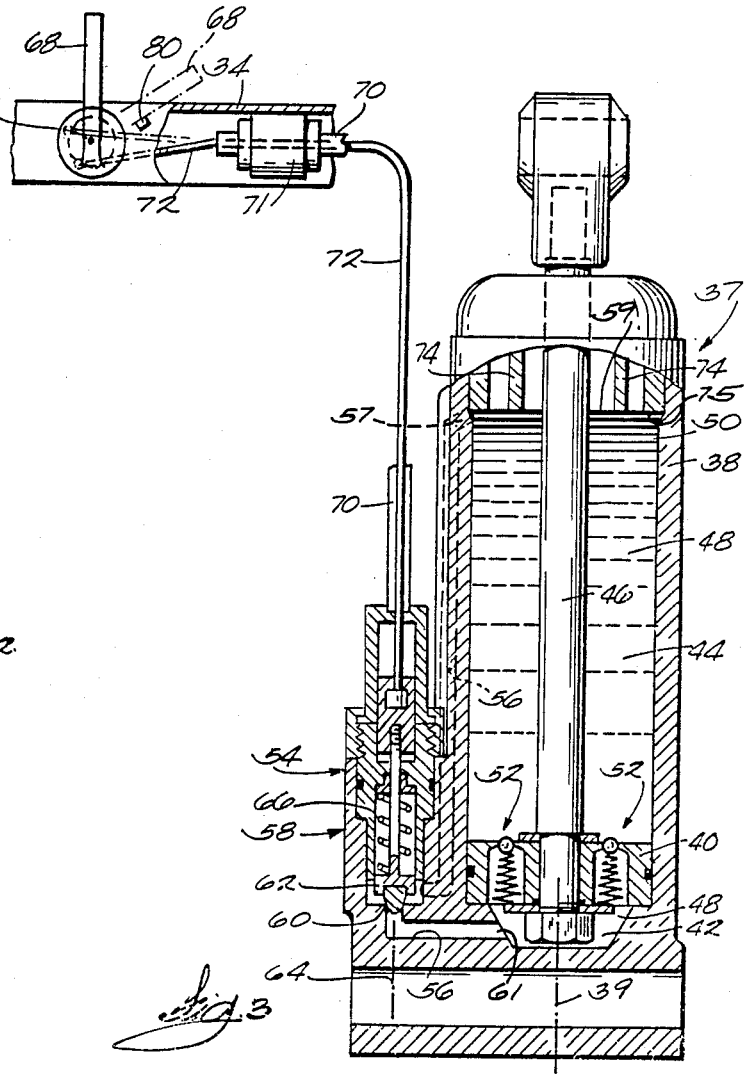
FIG. 3 is a rear view, partially in cross section, of the cylinder-piston assembly.

The marine propulsion device 10 further comprises a hydraulic cylinder-piston assembly 37 connected between the transom bracket 16 and the swivel bracket 18. In the illustrated construction, as best shown in FIGS. 2 and 3, the cylinder-piston assembly 37 includes a cylinder 38 having a longitudinal axis 39 and a lower end pivotally connected to the transom bracket 16 by a pivot pin 41, and a piston 40 slidably housed in the cylinder 38 and dividing the cylinder 38 into opposite first and second or lower and upper chambers 42 and 44, respectively. Both cylinder chambers contain incompressible hydraulic fluid 48. In the preferred embodiment, the lower chamber 42 contains substantially only incompressible fluid. The assembly 37 also includes a piston rod 46 extending through the upper chamber 44. The piston rod 46 has a lower end fixedly connected to the piston 40 and an upper end extending outwardly the cylinder 38 and being pivotally connected to the swivel bracket 18 by a pivot pin 47.

In order to permit rapid upward tilting movement of the propulsion unit 22 in the event the propulsion unit 22 strikes an underwater obstacle, the piston 40 has therein relief valve means 52 for permitting fluid flow from the upper chamber 44 to the lower chamber 42 when the pressure in the upper chamber 44 exceeds a predetermined value. In the preferred embodiment, the valve means 52 are conventional spring-loaded ball valves.

The piston 40 also includes means preventing fluid flow through the piston 40 from the lower chamber 42. In other words, there is no valve which permits fluid flow through the piston 40 from the lower chamber 42 to the upper chamber 44.

In order to assist manual upward tilting of the propulsion unit 22, the marine propulsion device 10 also comprises means including a pressurized gas or compressible fluid 50 for pressurizing the lower cylinder chamber 42. In the preferred embodiment, the upper chamber 44 contains the compressible fluid 50, preferably an inert gas such as nitrogen. The gas is pressurized (i.e., is above atmospheric pressure) so that it exerts a force on the hydraulic fluid 48 and thereby on the piston 40. The manner in which this assists manual tilting is described below.

In alternative embodiments, the means for pressurizing the lower chamber 42 can include a separate hydraulic accumulator containing the pressurized gas.

The marine propulsion device 10 also comprises means for selectively preventing diminishment of the volume of incompressible fluid in the lower chamber 42 to thereby prevent contraction of the hydraulic assembly 37 under all thrust conditions. While various suitable means can be used, in the preferred embodiment, this means includes means operable under all thrust conditions for locking the hydraulic assembly 37 in any one of an infinite number of tilt positions between the above-mentioned raised and lowered positions. Preferably, the locking means includes manually operable valve means 54 for selectively causing communication between the upper and lower chambers 44 and 42.

While various suitable valve means 54 can be employed, in the preferred embodiment, this means includes, in the cylinder 38, a conduit 56 communicating between the upper and lower chambers 44 and 42. The conduit 56 has an upper end 57 communicating with the upper chamber 44 at a point located such the upward movement of the piston 40 causes substantially only incompressible fluid to flow into the upper end of the conduit 56. In other words, the upper end 57 of the conduit 56 is located at least partially below the level 59 of the hydraulic fluid in the upper chamber 44. The conduit 56 has a lower end 61 communicating with the lower chamber 42.

The valve means 54 also includes a manually operable valve 58 for opening and closing the conduit 56. While various suitable valves can be employed, in the preferred embodiment, the valve 58 is an integral part of the cylinder 38 and includes a valve seat 60 located in the conduit 56, and a valve member 62 movable into and out of engagement with the valve seat 60 for respectively closing and opening the conduit 56. Preferably, the valve member 62 is movable along an axis 64 parallel to the longitudinal axis 39 of the cylinder 38. The valve 58 also includes a spring 66 biasing the valve member 62 into engagement with the valve seat 60, i.e., biasing the valve 58 closed.

The valve means 54 also includes operator actuatable means located remotely from the cylinder piston assembly 37 and from the valve 58, and means for actuating the valve 58, i.e., for moving the valve member 62 into and out of engagement with the valve seat 60, in response to actuation of the operator actuatable means.

While various suitable operator actuatable means can be employed, in the preferred embodiment, such means includes a lever 68 mounted on the tiller arm 34 for pivotal movement about an axis 69. The lever 68 includes a circular portion pivotally connected to the tiller arm 34 and an elongated portion extending radially from the circular portion. The lever 68 is movable between an open position (shown in phantom in FIG. 3) and a closed position (shown in solid lines in FIG. 3).

Figure 4:
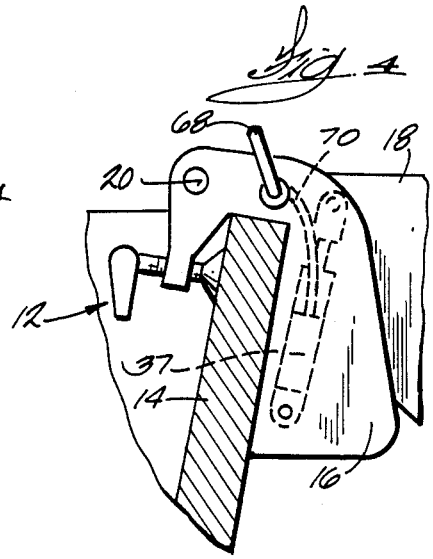
FIG. 4 is an enlarged, partial, side elevational view of a marine propulsion device which is an alternative embodiment of the invention.

In an alternative embodiment, which is illustrated in FIG. 4, the lever 68 is mounted on the transom bracket 16. This arrangement can be used, for example, when the marine propulsion device 10 is remote controlled and does not have a tiller arm.

While various suitable means can be used for moving the valve member 62 in response to actuation of the operation actuatable means, in the illustrated construction, this means includes cable means connected between the lever 68 and the valve member 62. As shown in FIG. 3, the cable means includes a cable sheath 70 having one end fixedly connected to the tiller arm 34 by conventional anchoring means 71, and another end fixedly connected to the cylinder 38. The cable means also includes a cable core 72 slideably extending through the cable sheath 70 and having one end fixedly connected to the lever 68 at a point spaced from the axis 69 and another end fixedly connected to the valve member 62. Preferably, the upper end of the cable core 72 is connected to the circular portion of the lever 68 such that, when the lever 68 is in the closed position, the valve member 62 engages the valve seat 60 under the influence of the spring 66, and such that pivotal movement of the lever 68 from the closed position to the open position moves the valve member 62 upwardly off the valve seat 60. Accordingly, pivotal movement of the lever 68 to the open position opens the valve 58, and return movement of the lever 68 to the closed position allows the valve 58 to close under the influence of the spring 66.

In the preferred embodiment, the valve means 54 also includes over-center means for releasably retaining the lever 68 in the open position. While various suitable over-center means can be used, in the illustrated construction, the over-center means includes a detent 80 on the tiller arm 34 for preventing the lever 68 from rotating beyond the open position, and the upper end of the cable core 72 is connected to the lever 68 such that movement of the lever 68 from the closed position to the open position causes the cable core 72 to move over or past the axis 69 of the lever 68, so that the force of the spring 66 transmitted to the cable core 72 via the valve member 62 releaseably retains the lever 68 in the open position. In order to return the lever 6B to the closed position, it is necessary for the operator to move the lever 68 toward the closed position with enough force to overcome the force of the spring 66. Thus, the spring 66 releaseably retains the lever 68 in both of the open and closed positions.

When the lever 68 is in the closed position, the valve 58 is closed and fluid flow through the conduit 56 is prevented. Accordingly, unless the propulsion unit 22 strikes an underwater obstacle and thereby opens the relief valve means 52, fluid cannot flow between the upper and lower cylinder chambers. This effectively locks the cylinder-piston assembly 37 in position under all thrust conditions, including full forward thrust, although the assembly 37 can extend slightly and permit a small amount of upward or reverse tilting because of the compressible gas 50 in the upper chamber 44.

When the lever 68 is moved to the open position, the valve 58 is opened and fluid flow through the conduit 56 is permitted. The communication between the chambers 42 and 44 permits movement of the piston 40 within the cylinder 38. Because the piston rod 46 extends through the upper chamber 44 and is connected to the piston 40, the area of the piston 40 exposed to the pressure in the upper chamber 44 is less than the area of the piston 40 exposed to the equal pressure in the lower chamber 42. Therefore, the pressure results in an upward force on the piston 40. Preferably, the pressure is such that this upward force is approximately 15 pounds less than the downward force exerted on the piston 40 by the weight of the propulsion unit 22. Accordingly, the cylinder-piston assembly 37 assists manual upward tilting of the propulsion unit 22 by significantly decreasing the force necessary to tilt the propulsion unit 22 upwardly. In alternative embodiments, the upward force exerted by the gas pressure can be greater than the downward force exerted by the weight of the propulsion unit 22, so that the cylinder-piston assembly 37 automatically tilts the propulsion unit 22 upwardly when the valve 58 is open.

The gas pressure and thus the upward force exerted on the piston 40 decreases as the piston rod 46 extends, because the overall volume of the cylinder chambers 42 and 44 increases as the volume of the piston rod 46 within the upper chamber 44 decreases. However, the downward force exerted on the piston 40 by the weight of the propulsion unit 22 also decreases as the propulsion unit 22 is tilted upwardly because the center of gravity of the propulsion unit 22 moves closer to the tilt axis 20. Therefore, the upward force on the piston 40 remains approximately 15 pounds less than the downward force on the piston 40 throughout the range of movement of the propulsion unit 22.

While some of the advantages of the invention can be obtained if the cylinder 38 is connected to the swivel bracket 18 and the piston rod 46 is connected to the transom bracket 16, it is preferable to have the hydraulic assembly 37 arranged as described above. Having the piston rod 46 connected to the swivel bracket 16 provides a stable trim position, because contraction of the hydraulic assembly 37 is resisted solely by an incompressible fluid (the hydraulic fluid 48 in the lower cylinder chamber 42). When the valve is closed, a constant volume of incompressible fluid is maintained in the lower cylinder chamber 42, and the hydraulic assembly 37 therefore cannot contract. Thus, the trim position is set.

If the hydraulic assembly 37 were arranged with the piston rod 46 connected to the transom bracket 16, contraction of the hydraulic assembly 37 would be opposed by a combination of an incompressible hydraulic fluid and a compressible gas, as disclosed in the previously mentioned Iwashita U.S. Pat. No. 4,493,659. Since the gas is compressible, the hydraulic assembly 37 would be able to contract even with the valve 58 closed. Therefore, this arrangement would provide a "mushy" or unstable trim setting. This arrangement would also heat the gas because the gas would be cyclically compressed by "bouncing" of the propulsion unit 22.

It is possible that repeated operation of the hydraulic assembly 37 could result in "foaming" or mixing of the fluid 48 and gas 50 in the upper chamber 44, whereby some gas would eventually be carried into the lower cylinder chamber 42. In order to correct this condition if it occurs, the marine propulsion device 10 further comprises means for returning the compressible fluid or gas from the lower cylinder chamber 42 to the upper cylinder chamber 44. While various suitable means can be employed, in the preferred embodiment, this means includes the relief valves 52 in the piston 40, and means for selectively opening the relief valves 52. Preferably, this opening means includes a ring 74 depending into the upper cylinder chamber 44 from the upper wall of the cylinder 38. When the hydraulic assembly 37 is fully extended, i.e., when the propulsion unit 22 is moved to its uppermost tilt position, the ring 74 opens the relief valves 52 and permits gas to flow from the lower cylinder chamber 42 to the upper cylinder chamber 44. When the propulsion unit 22 is subsequently lowered to its trim position, the lower chamber 42 will contain only incompressible hydraulic fluid 48 and will therefore provide a stable trim position.

The ring 74 and a shoulder 75 within the cylinder 38 also limit upward movement of the piston 40 and prevent the piston 40 from moving above the level 59 of incompressible fluid in the upper chamber 44, so that upward movement of the piston 40 does not force gas out of the upper chamber 44. As shown in FIG. 3, the lower end of the ring 74 and the lower end of the shoulder 75 are approximately even with or slightly below the level 59.

The cylinder-piston assembly 37 is used as follows to trim the propulsion unit 22. During initial forward acceleration of the boat, the lever 68 is located in the open position so that the force exerted on the propulsion unit 22 by the forward thrust of the propeller 26 fully contracts the cylinder-piston assembly 37, i.e., moves the piston 40 to the position minimizing the volume of the lower cylinder chamber 42. When the boat is on plane, the lever 68 is left in the open position, and the boat is decelerated, so that the drag forces exerted on the propulsion unit 22 by the water and the force exerted on the piston 40 by the fluid pressure move the propulsion unit 22 outwardly and extend the cylinder-piston assembly 37. When the propulsion unit 22 reaches the desired trim position, the propulsion unit 22 is locked in position by moving the lever 68 to the closed position.

As mentioned above, the propulsion unit 22 can be manually moved through its tilt range when the lever 68 is in the open position, and can be locked in any position throughout the tilt range simply by moving the lever 68 to the closed position.

Various feature of the invention are set forth in the following claims.

We claim:

1. A marine propulsion device comprising a propulsion unit adapted to be mounted on the transom of a boat for pivotal movement relative to the transom about a generally horizontal tilt axis, and for pivotal movement relative to the transom about a generally vertical steering axis, said propulsion unit including an engine adapted to be drivingly connected to a propeller, a tiller arm connected to said propulsion unit for causing pivotal movement of said propulsion unit about said steering axis, a hydraulic assembly including a cylinder connected to one of said propulsion unit and the transom, a piston slideably received in said cylinder and dividing said cylinder into opposite first and second chambers, and a piston rod having one end fixedly connected to said piston and an opposite end extending outwardly of said cylinder and being connected to the other of said propulsion unit and the transom, valve means for alternatively permitting and preventing fluid flow between said chambers, operator actuatable means mounted on said tiller arm, and means for actuating said valve means in response to actuation of said operator actuatable means.

2. A marine propulsion device as set forth in claim 1 wherein said operator actuatable means includes a lever movably mounted on said tiller arm.

3. A marine propulsion device as set forth in claim 2 wherein said lever is pivotally mounted on said tiller arm.

4. A marine propulsion device as set forth in claim 2 wherein said lever is movable between first and second positions for respectively opening and closing said valve means, and wherein said valve means also includes over-center means for releasably retaining said lever in said first position.

5. A marine propulsion device as set forth in claim 2 wherein said means for actuating said valve includes cable means.

6. A marine propulsion device as set forth in claim 1 wherein said second chamber contains compressible fluid, and wherein said device further comprises means for returning compressible fluid from said first chamber to said second chamber.

7. A marine propulsion device as set forth in claim 6 wherein said returning means includes means for selectively permitting fluid flow through said piston from said first chamber to said second chamber.

8. A marine propulsion device as set forth in claim 7 wherein said assembly further includes, in said piston, relief means for permitting fluid flow from said second chamber to said first chamber when the pressure in said second chamber exceeds a predetermined value, and wherein said returning means includes means for opening said relief means when said piston is located in the position minimizing the volume of said second chamber.

9. A marine propulsion device as set forth in claim 1 wherein said cylinder has a longitudinal axis, and wherein said valve means includes a valve seat, and a valve member movable along an axis parallel to said longitudinal axis and movable into and out of engagement with said valve seat.

10. A marine propulsion device as set forth in claim 1 wherein said cylinder contains a compressible fluid and an incompressible fluid, wherein said piston rod extends through said second chamber of said cylinder, wherein said valve means alternatively permits and prevents fluid flow from said first chamber to said second chamber, and wherein said marine propulsion device also comprises means for selectively and alternatively permitting and preventing contraction of said assembly under all thrust conditions, said means for selectively and alternatively permitting and preventing contraction of said assembly including said valve means.

11. A marine propulsion device as set forth in claim 10 wherein said valve means includes a conduit communicating between said first and second chambers, and a valve for opening and closing said conduit.

12. A marine propulsion device as set forth in claim 11 wherein said valve is operable between a first mode wherein said valve permits fluid flow in both directions through said conduit, and a second mode wherein said valve permits fluid flow in neither direction through said conduit.

13. A marine propulsion device as set forth in claim 12 wherein said assembly further includes, in said piston, relief means for permitting fluid flow from said second chamber to said first chamber when the pressure in said second chamber exceeds a predetermined value.

14. A marine propulsion device as set forth in claim 13 wherein said first and second chambers are communicable solely via said valve means and said relief means.

15. A marine propulsion device comprising a transom bracket adapted to be fixedly mounted on the transom of a boat, a propulsion unit mounted on said transom bracket for pivotal movement relative thereto about a generally horizontal tilt axis, said propulsion unit including an engine adapted to be drivingly connected to a propeller, a hydraulic assembly including a cylinder connected to one of said propulsion unit and said transom bracket, a piston slideably received in said cylinder and dividing said cylinder into opposite first and second chambers, and a piston rod having one end fixedly connected to said piston and an opposite end extending outwardly of said cylinder and being connected to the other of said propulsion unit and said transom bracket, valve means for alternatively permitting and preventing fluid flow between said chambers, operator actuatable means mounted on said transom bracket, and means for actuating said valve means in response to actuation of said operator actuatable means.

16. A marine propulsion device as set forth in claim 15 wherein said operator actuatable means includes a lever movably mounted on said transom bracket.

17. A marine propulsion device as set forth in claim 16 wherein said lever is pivotally mounted on said transom bracket.

18. A marine propulsion device as set forth in claim 16 wherein said lever is movable between first and second positions for respectively opening and closing said valve means, and wherein said valve means also includes over-center means for releasably retaining said lever in said first position.

19. A marine propulsion device as set forth in claim 16 wherein said means for actuating said valve includes cable means.

20. A marine propulsion device as set forth in claim 15 wherein said second chamber contains compressible fluid, and wherein said device further comprises means for returning compressible fluid from said first chamber to said second chamber.

21. A marine propulsion device as set forth in claim 20 wherein said returning means includes means for selectively permitting fluid flow through said piston from said first chamber to said second chamber.

22. A marine propulsion device as set forth in claim 21 wherein said assembly further includes, in said piston, relief means for permitting fluid flow from said second chamber to said first chamber when the pressure in said second chamber exceeds a predetermined value, and wherein said returning means includes means for opening said relief means when said piston is located in the position minimizing the volume of said second chamber.

23. A marine propulsion device as set forth in claim 15 wherein said cylinder has a longitudinal axis, and wherein said valve means includes a valve seat, and a valve member movable along an axis parallel to said longitudinal axis and movable into and out of engagement with said valve seat.

24. A marine propulsion device comprising a propulsion unit adapted to be mounted on the transom of a boat for pivotal movement relative to the transom about a generally horizontal tilt axis, said propulsion unit including an engine adapted to be drivingly connected to a propeller, a hydraulic assembly including a cylinder having a longitudinal axis and being connected to one of said propulsion unit and the transom, a piston slideably received in said cylinder and dividing said cylinder into upper and lower chambers, and a piston rod having one end fixedly connected to said piston and a second end extending outwardly of said cylinder and being connected to the other of said propulsion unit and the transom, means including a pressurized gas for pressurizing said chambers, and means for selectively preventing diminishment of the volume of incompressible fluid in said lower chamber to thereby prevent contraction of said assembly under all thrust conditions, said preventing means including valve means located exteriorly of said piston for controlling fluid flow between said chambers, said valve means including a valve seat, and a valve member movable along an axis parallel to said longitudinal axis and movable into and out of engagement with said valve seat.

25. A method for setting the trim position of a marine propulsion device mounted on a boat, the marine propulsion device comprising a propulsion unit mounted for pivotal movement relative to the boat about a generally horizontal tilt axis, a contractable and extendible hydraulic assembly including a cylinder connected to one of the propulsion unit and the transom, a piston slideably received in the cylinder and dividing the cylinder into opposite first and second chambers, and a piston rod having one end fixedly connected to the piston and an opposite end extending outwardly of the cylinder and being connected to the other of the propulsion unit and the transom, and manually operable valve means for alternatively permitting fluid flow between the chambers, and preventing fluid flow between the chambers, said method comprising the steps of contracting the hydraulic assembly by accelerating the boat while the valve means is open to permit fluid flow between the chambers, extending the hydraulic assembly by decelerating the boat while the valve means is open to permit fluid flow between the chambers, and locking the propulsion unit in the desired trim position.

26. A method as set forth in claim 25 wherein said locking step includes the step of closing the valve means to prevent fluid flow between the chambers.

27. A hydraulic assembly comprising a cylinder having a longitudinal axis, a piston slideably received in said cylinder and dividing said cylinder into upper and lower chambers, a piston rod having one end fixedly connected to said piston and a second end extending outwardly of said cylinder, means including a pressurized gas for pressurizing said chambers, and means for selectively preventing diminishment of the volume of incompressible fluid in said lower chamber to thereby prevent contraction of said assembly under all thrust conditions, said preventing means including valve means located exteriorly of said piston for controlling fluid flow between said chambers, said valve means including a valve seat, and a valve member movable along an axis parallel to said longitudinal axis and movable into and out of engagement with said valve seat.

28. A marine propulsion device comprising a propulsion unit adapted to be mounted on the transom of a boat for pivotal movement relative thereto about a generally horizontal tilt axis, said propulsion unit including an engine adapted to be drivingly connected to a propeller, an extendable and contractible hydraulic assembly including a cylinder pivotally connected to one of the transom and said propulsion unit, and a piston slideably housed in said cylinder, said cylinder and said piston defining a chamber containing substantially only incompressible fluid and having a variable volume which diminishes when said assembly contracts, and said assembly also including a piston rod having one end fixedly connected to said piston and an opposite end pivotally connected to the other of the transom and said propulsion unit, means including a pressurized gas for pressurizing said chamber, and means for selectively preventing diminishment of the volume of incompressible fluid in said chamber to thereby prevent contraction of said assembly under all thrust conditions.

29. A marine propulsion device as set forth in claim 28 wherein said assembly is extendable between a fully contracted position and a fully extended position, and wherein said means for preventing diminishment includes means for selectively locking said assembly in any one of an infinite number of positions between said fully contracted position and said fully extended position.

30. A marine propulsion device as set forth in claim 28 wherein said piston defines a second chamber in said cylinder, wherein said piston rod extends through said second chamber, and wherein said second chamber contains said gas.

31. A marine propulsion device as set forth in claim 30 wherein said preventing means includes means for selectively causing communication between said first-mentioned chamber and said second chamber, said means for causing communication including conduit means communicating between said first-mentioned chamber and said second chamber, and valve means for selectively and alternatively opening and closing said conduit means.

32. A marine propulsion device as set forth in claim 31 wherein said second chamber contains incompressible fluid, and wherein said conduit means includes an end communicating with said second chamber at a point located such that movement of said piston in the direction minimizing the volume of said second chamber causes substantially only incompressible fluid to flow into said end of said conduit means.

33. A marine propulsion device as set forth in claim 28 wherein said preventing means includes a second chamber containing incompressible fluid, and said pressurized gas, and means for selectively causing communication between said incompressible fluid in said first-mentioned chamber and said incompressible fluid in said second chamber.

34. A marine propulsion device as set forth in claim 33 wherein said second chamber is defined by said piston in said cylinder, and wherein said piston rod extends through said second chamber.

35. A marine propulsion device comprising a propulsion unit adapted to be mounted on the transom of a boat for pivotable movement relative thereto about a generally horizontal tilt axis, said propulsion unit including an engine adapted to be drivingly connected to a propeller, a hydraulic assembly including a cylinder having a lower end pivotally connected to the transom, and a piston dividing said cylinder into upper and lower chambers, said upper chamber containing pressurized gas and incompressible fluid, and said lower chamber containing substantially only incompressible fluid, and said assembly also including a piston rod extending through said upper chamber and having a lower end fixedly connected to said piston and an upper end pivotally connected to said propulsion unit, a conduit communication between said upper and lower chambers, said conduit having an upper end communicating with said upper chamber at a point located below the level of incompressible fluid in said under chamber, a manually operable valve for opening and closing said conduit, and means for preventing movement of said piston above the level of incompressible fluid in said upper chamber.

36. A marine propulsion device as set forth in claim 35 and further comprising means for returning gas through said piston from said lower chamber to said upper chamber.

37. A marine propulsion device as set forth in claim 36 wherein said returning means includes valve means in said piston for preventing fluid flow from said lower chamber to said upper chamber and for permitting fluid flow from said upper chamber to said lower chamber when the pressure in said upper chamber exceeds a predetermined value, and means for opening said valve means when said hydraulic assembly is fully extended.

38. A marine propulsion device as set forth in claim 37 wherein said means for preventing movement of said piston above the level of incompressible fluid in said upper chamber includes said means for opening said valve means.

39. A marine propulsion device comprising a propulsion unit adapted to be mounted on the transom of a boat for pivotal movement relative thereto about a generally horizontal tilt axis, said propulsion unit including an engine adapted to be drivingly connected to a propeller, an extendable and contractible hydraulic assembly including a cylinder pivotally connected to one of the transom and said propulsion unit, and a piston slideably housed in said cylinder, said cylinder and said piston defining a chamber containing substantially only incompressible fluid and having a variable volume which diminishes when said assembly contracts, and said piston including means preventing flow through said piston from said chamber, and said assembly also including a piston rod having one end fixedly connected to said piston and an opposite end pivotally connected to the other of the transom and said propulsion unit, means including a pressurized gas for pressurizing said chamber, and means located exteriorly of said piston for selectively and alternatively preventing and permitting diminishment of the volume of incompressible fluid in said chamber to thereby respectively prevent contraction of said assembly under all thrust conditions and permit contraction of said assembly.

* * * * *